US009188345B1

(12) United States Patent
Lu

(10) Patent No.: US 9,188,345 B1
(45) Date of Patent: Nov. 17, 2015

(54) ELECTRIC FIREPLACE HAVING MULTI-FUNCTION FLAME

(71) Applicant: Dong Guan Song Wei Electric Technology Co., Ltd., Dongguan (CN)

(72) Inventor: Weilin Lu, Dongguan (CN)

(73) Assignee: Dong Guan Song Wei Electric Technology Co., Ltd., Dongguan, Guangdong (CN)

( * ) Notice: Subject to any disclaimer, the term of this patent is extended or adjusted under 35 U.S.C. 154(b) by 0 days.

(21) Appl. No.: 14/656,698

(22) Filed: Mar. 12, 2015

(30) Foreign Application Priority Data

May 20, 2014 (CN) ..... 2014 1 0211805

(51) Int. Cl.
*F24B 1/18* (2006.01)
*F24C 7/00* (2006.01)

(52) U.S. Cl.
CPC ..... *F24C 7/004* (2013.01)

(58) Field of Classification Search
CPC ..... F24C 7/004; F21S 10/04; G09F 19/12; A63J 5/023; F21W 2131/406
See application file for complete search history.

(56) References Cited

U.S. PATENT DOCUMENTS

| | | | | |
|---|---|---|---|---|
| 5,266,817 | A * | 11/1993 | Lin | 257/89 |
| 2008/0105884 | A1* | 5/2008 | Wu et al. | 257/88 |
| 2012/0155075 | A1* | 6/2012 | Asofsky et al. | 362/231 |
| 2013/0077287 | A1* | 3/2013 | Lu | 362/92 |
| 2014/0004423 | A1* | 1/2014 | Endo et al. | 429/223 |
| 2014/0185281 | A1* | 7/2014 | Lee et al. | 362/231 |

FOREIGN PATENT DOCUMENTS

| | | | |
|---|---|---|---|
| CN | 201050823 Y | * | 4/2008 |
| CN | 201819303 U | * | 5/2011 |
| CN | 202521701 U | * | 11/2012 |

* cited by examiner

*Primary Examiner* — Casandra Davis
(74) *Attorney, Agent, or Firm* — Leong C. Lei

(57) ABSTRACT

An electric fireplace having multi-function flame includes a housing, a projection screen, a plastic screen, plastic crystals, a first illuminating device, a flame image plate, a reflection assembly, and a second illuminating device. The first illuminating device can shoot a single color or two colors or a combination of more than two colors of light. The second illuminating device includes a plurality of second lights disposed on a second circuit board. Each of the second lights includes at least two different chips. The second illuminating device can shoot a single color or two colors or a combination of more than two colors of light. The present invention can generate single or multi-color flame to achieve a multi-function purpose. The change effect of the movement and color of the flame can be more perfect and realistic and appreciation.

9 Claims, 3 Drawing Sheets

ELECTRIC FIREPLACE HAVING MULTI-FUNCTION FLAME

(a) TECHNICAL FIELD OF THE INVENTION

The present invention relates to an electric fireplace, and more particularly to an electric fireplace having multi-function flame.

(b) DESCRIPTION OF THE PRIOR ART

In the early days, a fireplace can be used for lighting, warming, baking. With the development of economy and technology, the three functions of lighting, warming, baking are gradually improved and separated. These days, a fireplace becomes special warming equipment.

With the development of times, fireplaces are improved from the traditional fireplaces, such as wood burning fireplaces, fuel gas fireplaces or charcoal fireplaces, to electric fireplaces. The electric fireplaces come from the European classical fireplaces to cooperate with acoustics and optics technique to make a great change for the traditional fireplaces. The electric fireplaces are green and friendly-environmental and provide a realistic burning effect.

In these days, electric fireplaces are rapidly developed to substitute the traditional fireplaces. However, the existing electric fireplaces only provide a single color flame and a single function, without aesthetic feeling. Accordingly, the inventor of the present invention has devoted himself based on his many years of practical experiences to solve this problem.

SUMMARY OF THE INVENTION

The primary object of the present invention is to provide an electric fireplace having multi-function flame to overcome the shortcomings of the existing electric fireplaces.

In order to achieve the aforesaid object, the electric fireplace having multi-function flame of the present invention comprises a housing, a projection screen, a plastic screen, plastic crystals, a first illuminating device, a flame image plate, a reflection assembly, and a second illuminating device disposed in the housing. The housing has a window. The projection screen and the plastic screen are located at an inner side of the window. The projection screen is disposed vertically. The plastic screen is levelly disposed at a lower end of a front side of the projection screen. The plastic crystals are disposed on an upper surface of the plastic screen. The first illuminating device comprises a first circuit board and a plurality of first lights disposed on the first circuit board. Each of the first lights comprises at least two different chips. The first illuminating device projects at least one colored light on the plastic screen, and then the light is reflected to the plastic crystals. The flame image plate, the reflection assembly, and the second illuminating device are disposed in back of the projection screen. The flame image plate has a plurality of flame holes thereon. The reflection assembly is rotatable. The second illuminating device comprises a second circuit board and a plurality of second lights disposed on the second circuit board. Each of the second lights comprises at least two different chips. The second illuminating device projects at least one colored light on the reflection assembly, and then the light is reflected to the projection screen.

Compared to the prior art, the present invention has obvious advantages and beneficial effects described as below. Through the plurality of first lights disposed on the first circuit board of the first illuminating device and the at least two different chips of each first light, the first illuminating device can shoot a single color or two colors or a combination of more than two colors of light. The colored light is projected on the plastic screen and then diverted to the plastic crystals. The user can see the plastic crystals illuminating and shining through the window. Through the plurality of second lights disposed on the second circuit board of the second illuminating device and the at least two different chips of each second light, the second illuminating device can shoot a single color or two colors or a combination of more than two colors of light. The colored light is reflected by the reflection assembly to project on the projection screen. The user can see imitation flame dancing behind the projection screen through the window. The present invention can generate single or multi-colored flame to achieve multiple functions. The change effect of the movement and color of the flame can be more perfect and realistic and appreciation. For aesthetic requirements, especially applicable for electric fireplace cabinets and home decoration use, the present invention improves the quality of life and market prospects and has significant economic benefits.

The flame image plate is disposed between the reflection assembly and the second illuminating device and extends outward from the support. The flame image plate is located above the second illuminating device to cover the second illuminating device, so that the light from the second illuminating device is first formed through the flame image plate and then reflected by the reflection assembly to project on the projection screen so as to enhance the flame imitation effect greatly and to reduce the material of the flame image plate and the occupying space effectively. The flame image plate can be installed conveniently.

DETAILED DESCRIPTION OF THE PREFERRED EMBODIMENTS

Embodiments of the present invention will now be described, by way of example only, with reference to the accompanying drawings.

Figure 1:
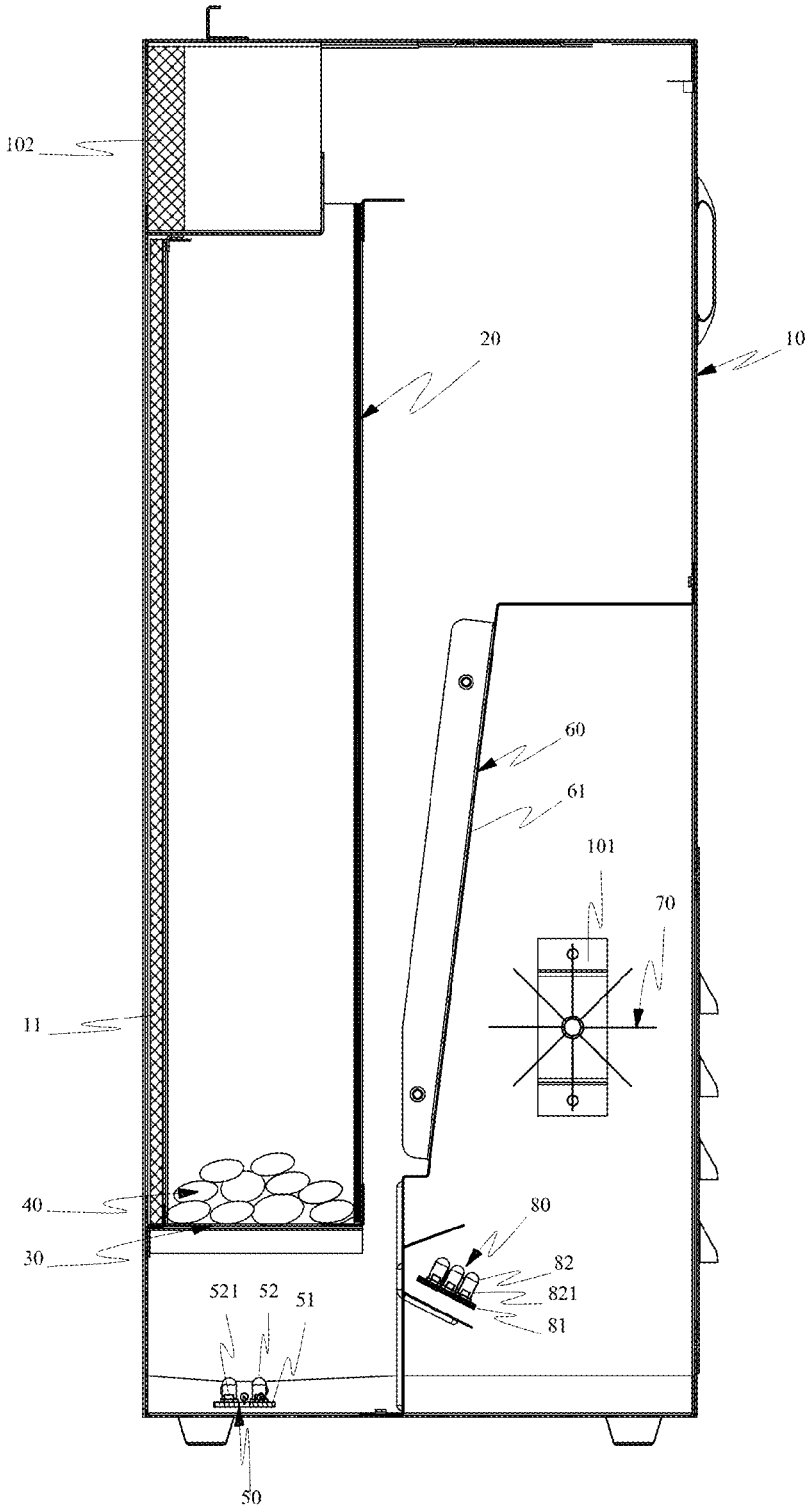
FIG. 1 is a sectional view according to a first embodiment of the present invention.

As shown in FIG. 1, the electric fireplace according to a first embodiment of the present invention comprises a housing 10, a projection screen 20, a plastic screen 30, plastic crystals 40, a first illuminating device 50, a flame image plate 60, a reflection assembly 70, and a second illuminating device 80 disposed in the housing 10.

The housing 10 has a rectangular shape. The housing 10 has a window 11 located at a front side thereof. The window 11 is a tempered glass or a meshed door. The imitation flame projected from the inside of the housing 10 can be seen through the window 11.

Both the projection screen 20 and the plastic screen 30 are located at an inner side of the window 11. The projection screen 20 is disposed vertically. Two surfaces of the projection screen 20 faces forward and rearward, respectively. The plastic screen 30 is levelly disposed at a lower end of a front side of the projection screen 20. Two surfaces of the plastic screen 30 faces forward and rearward, respectively. The plastic crystals 40 are disposed on an upper surface of the plastic screen 30. The plastic crystals 40 are in a circle, an oval, a rhombus, a polygon, or a square shape. The color of the plastic crystals 40 is transparent, red, yellow, green, blue, or cyan.

The first illuminating device 50 comprises a first circuit board 51 and a plurality of first lights 52 disposed on the first circuit board 51. Each first light 52 comprises at least two different chips 521. In this embodiment, each first light 52 comprises four chips 521 which are red, yellow, blue, and green. The chips 521 are encapsulated separately or integrally on the first circuit board 51. In this embodiment, the chips 521 are encapsulated separately for convenient maintenance and replacement. The first illuminating device 50 projects at least one colored light on the plastic screen 30, and then the light is reflected to the plastic crystals 40.

The flame image plate 60, the reflection assembly 70, and the second illuminating device 80 are disposed in back of the projection screen 20. The flame image plate 60 has a plurality of flame holes 61 thereon. The reflection assembly 70 is rotatable. In this embodiment, the flame image plate 60 is disposed between the projection screen 20 and the reflection assembly 70. The reflection assembly 70 is driven by a synchronous motor 101 to turn at a predetermined speed.

The second illuminating device 80 is located under the reflection assembly 70. The second illuminating device 80 comprises a second circuit board 81 and a plurality of second lights 82 disposed on the second circuit board 81. Each second light 82 comprises at least two different chips 821. In this embodiment, each second light 82 comprises four chips 821 which are red, yellow, blue, and green. The chips 821 are encapsulated separately or integrally on the second circuit board 81. In this embodiment, the chips 821 are encapsulated separately for convenient maintenance and replacement.

The second illuminating device 80 projects at least one colored light on the reflection assembly 70, and then the light is reflected to the projection screen 20.

The present invention further comprises a controller 102. The controller 102 is adapted to control the first illuminating device 50 and the second illuminating device 80 to illuminate, such that the present invention can form one or more colors of imitation flame during work.

When in use, the controller 102 is used to control the first illuminating device 50 and the second illuminating device 80. The first illuminating device 50 shoots a single color or two colors or a combination of more than two colors of light within a certain time interval in turn automatically. The colored light is projected on the plastic screen 30 and then diverted to the plastic crystals 40. The user can see the plastic crystals 40 illuminating and shining through the window 11. The second illuminating device 80 shoots a single color or two colors or a combination of more than two colors of light within a certain time interval in turn automatically. The colored light is reflected by the reflection assembly 70 to project on the projection screen 20 through the flame holes 61. The user can see imitation flame dancing behind the projection screen 20 through the window 11. Besides, the first illuminating device 50 and the second illuminating device 80 are controlled by the controller 102 to shoot a single color or two colors or a combination of more than two colors of light within a certain time interval in turn automatically. The illumination of the first illuminating device 50 and the second illuminating device 80 can be adjusted through the controller 102.

Figure 2:
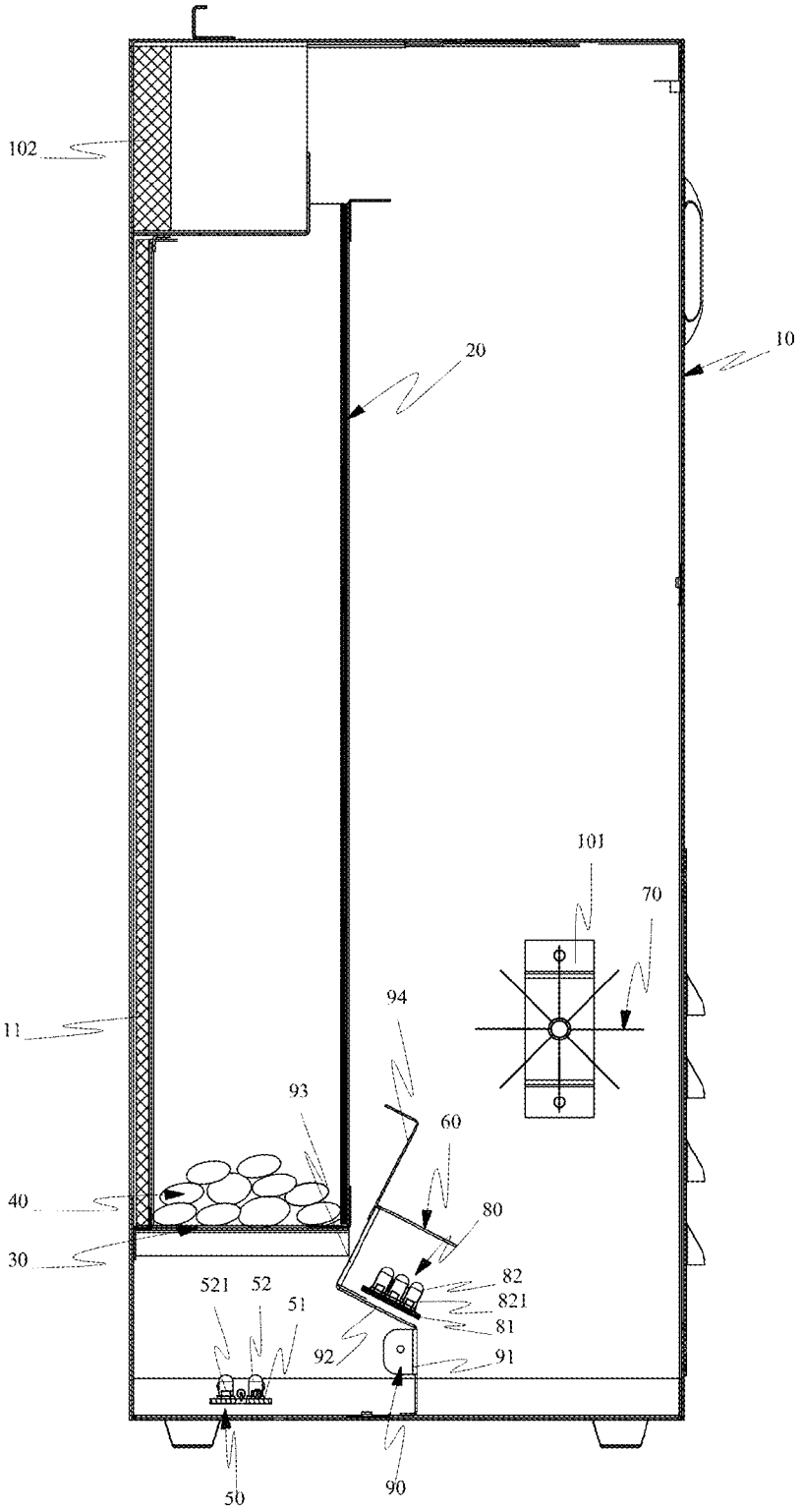
FIG. 2 is a sectional view according to a second embodiment of the present invention.
Figure 3:
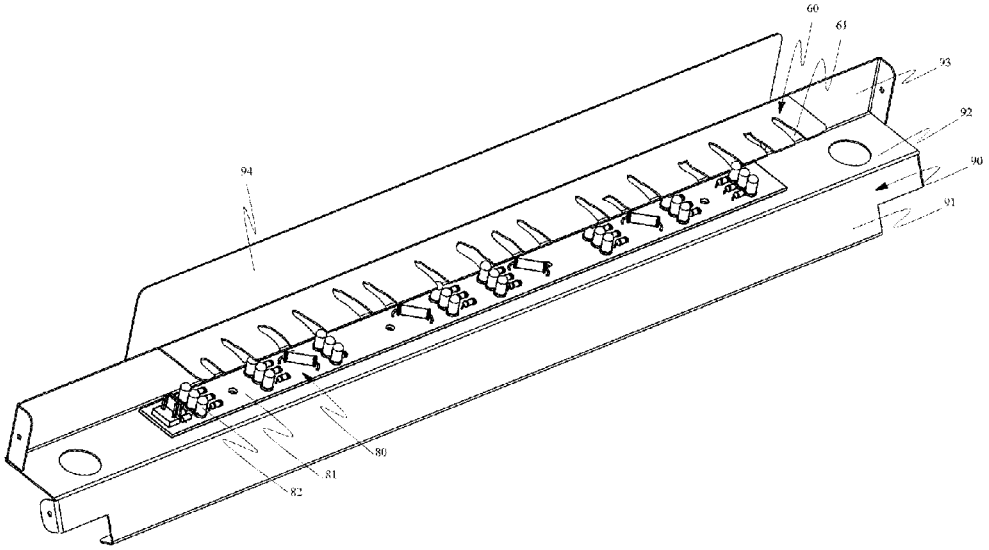
FIG. 3 is a perspective view showing the second illuminating device according to the second embodiment of the present invention.

FIG. 2 and FIG. 3 show a second embodiment of the present invention. The second embodiment is substantially similar to the first embodiment with the exceptions described hereinafter.

In the second embodiment, the flame image plate 60 is located between the reflection assembly 70 and the second illuminating device 80. The second illuminating device 80 is located under the reflection assembly 70. The second illuminating device 80 is installed on a support 90. The flame image plate 60 is disposed on the support 90 and bent to extend outward. Specifically, the support 90 comprises an installation portion 91, a bearing portion 92, and a connection portion 93 which are integrally formed. The installation portion 91 is vertically disposed. The installation portion 91 is fixed to the inner bottom of the housing 10. The bearing portion 92 extends obliquely, forward and upward. The connection portion 93 extends obliquely, rearward and upward. The second illuminating device 80 is fixed on the surface of the bearing portion 92. The flame image plate 60 is bent at the distal end of the connection portion 93 to extend obliquely, rearward and downward. In this embodiment, the connection portion 93 is perpendicular to the bearing portion 92. The flame image plate 60 is parallel to the bearing portion 92. The flame image plate 60 is disposed above the second illuminating device 80 to cover the second illuminating device 80. The top end of the connection portion 93 is provided with a stop plate 94. The stop plate 94 is in a reverse L shape. The stop plate 94 extends obliquely and upward. The stop plate 94 is adapted to block the light, so that most of the light is projected on the reflection assembly 70.

The work procedure of the second embodiment is similar to that of the first embodiment with the exceptions described hereinafter. The colored light from the second illuminating device 80 shoots the reflection assembly 70 through the flame holes 61 of the flame image plate 60, and then is reflected by the reflection assembly 70 to project on the projection screen 20. This way also achieves the projection of colored light and generates imitation dancing flame behind the projection screen 20.

Although particular embodiments of the present invention have been described in detail for purposes of illustration, various modifications and enhancements may be made without departing from the spirit and scope of the present invention. Accordingly, the present invention is not to be limited except as by the appended claims.

I claim:

1. An electric fireplace having multi-function flame, comprising a housing, a projection screen, a plastic screen, plastic crystals, a first illuminating device, a flame image plate, a reflection assembly, and a second illuminating device disposed in the housing; the housing having a window, the projection screen and the plastic screen being located at an inner side of the window, the projection screen being disposed vertically, the plastic screen being levelly disposed at a lower end of a front side of the projection screen, the plastic crystals being disposed on an upper surface of the plastic screen; the first illuminating device comprising a first circuit board and a plurality of first lights disposed on the first circuit board, the first lights each comprising at least two different chips; the first illuminating device projecting at least one colored light on the plastic screen and then the light being reflected to the plastic crystals; the flame image plate, the reflection assembly, and the second illuminating device being disposed in back of the projection screen, the flame image plate having a plurality of flame holes thereon, the reflection assembly being rotatable; the second illuminating device comprising a second circuit board and a plurality of second lights disposed on the second circuit board, the second lights each comprising at least two different chips; the second illuminating device projecting at least one colored light on the reflection assembly and then the light being reflected to the projection screen, wherein the flame image plate is located between the reflection assembly and the second illuminating device, the second illuminating device being located under the reflection assembly, the second illuminating device being installed on a support, the flame image plate being disposed on the support and bent to extend outward.

2. The electric fireplace having multi-function flame as claimed in claim 1, wherein the flame image plate is disposed between the projection screen and the reflection assembly, the second illuminating device being located under the reflection assembly.

3. The electric fireplace having multi-function flame as claimed in claim 1, wherein the support comprises an installation portion, a bearing portion, and a connection portion which are integrally formed, the installation portion being vertically disposed, the bearing portion extending obliquely, forward and upward, the connection portion extending obliquely, rearward and upward, the second illuminating device being fixed on a surface of the bearing portion, the flame image plate being bent at a distal end of the connection portion to extend obliquely, rearward and downward.

4. The electric fireplace having multi-function flame as claimed in claim 3, wherein the connection portion is perpendicular to the bearing portion, the flame image plate being perpendicular to the connection portion, a top end of the connection portion being provided with a stop plate, the stop plate having a reverse L shape, the stop plate extending obliquely and upward.

5. The electric fireplace having multi-function flame as claimed in claim 1, wherein the first lights each comprises four chips which are red, yellow, blue, and green and encapsulated separately or integrally on the first circuit board, the second lights each comprising four chips which are red, yellow, blue, and green and encapsulated separately or integrally on the second circuit board.

6. The electric fireplace having multi-function flame as claimed in claim 1, further comprising a controller for controlling the first illuminating device and the second illuminating device.

7. The electric fireplace having multi-function flame as claimed in claim 1, wherein the reflection assembly is driven by a synchronous motor.

8. The electric fireplace having multi-function flame as claimed in claim 1, wherein the plastic crystals are in a circle, an oval, a rhombus, a polygon, or a square shape.

9. The electric fireplace having multi-function flame as claimed in claim 1, wherein the color of the plastic crystals is transparent, red, yellow, green, blue, or cyan.

* * * * *